US008507061B2

(12) United States Patent
Quigley et al.

(10) Patent No.: US 8,507,061 B2
(45) Date of Patent: Aug. 13, 2013

(54) WET FRICTION MATERIAL FOR BLOW MOLDED ARTICLES

(75) Inventors: Steven Francis Quigley, Kennebunkport, ME (US); Chandrasen Gajria, Hingham, MA (US)

(73) Assignee: The Gillette Company, Boston, MA (US)

( * ) Notice: Subject to any disclaimer, the term of this patent is extended or adjusted under 35 U.S.C. 154(b) by 14 days.

(21) Appl. No.: 13/331,325

(22) Filed: Dec. 20, 2011

(65) Prior Publication Data

US 2012/0171400 A1 Jul. 5, 2012

Related U.S. Application Data

(60) Provisional application No. 61/429,810, filed on Jan. 5, 2011.

(51) Int. Cl.
*B32B 1/00* (2006.01)
*B32B 1/02* (2006.01)

(52) U.S. Cl.
USPC ..... 428/35.7; 428/36.92

(58) Field of Classification Search
USPC ..... 428/34.1, 34.4–34.7, 35.7, 36.4, 428/36.6, 36.7, 36.92
See application file for complete search history.

(56) References Cited

U.S. PATENT DOCUMENTS

| | | | |
|---|---|---|---|
| 3,972,528 | A | 8/1976 | McCracken et al. |
| 4,619,803 | A | 10/1986 | Yu |
| 4,846,359 | A | 7/1989 | Baird et al. |
| 5,314,940 | A | 5/1994 | Stone |
| 5,670,263 | A | 9/1997 | Gazeley |
| 5,711,061 | A | 1/1998 | Blake et al. |
| 6,610,382 | B1 | 8/2003 | Kobe et al. |
| 6,904,615 | B2 | 6/2005 | Kobe et al. |
| 7,098,292 | B2 | 8/2006 | Zhao et al. |
| 2002/0114920 | A1 | 8/2002 | Scholz et al. |
| 2005/0032969 | A1 | 2/2005 | Hamersky et al. |
| 2006/0110556 | A1 | 5/2006 | Kitzmiller |
| 2006/0175738 | A1 | 8/2006 | Connolly et al. |
| 2007/0048473 | A1 | 3/2007 | Connolly et al. |
| 2007/0128255 | A1 | 6/2007 | Belcher et al. |
| 2008/0063824 | A1 | 3/2008 | Mangin |
| 2008/0150198 | A1 | 6/2008 | Gerlach |
| 2009/0105396 | A1 | 4/2009 | Fujihara et al. |
| 2009/0212454 | A1 | 8/2009 | Smith et al. |
| 2011/0143112 | A1 | 6/2011 | Cai et al. |

FOREIGN PATENT DOCUMENTS

WO WO 03/072447 A1 9/2003

*Primary Examiner* — Walter B Aughenbaugh
(74) *Attorney, Agent, or Firm* — Kevin C. Johnson; Steven W. Miller

(57) ABSTRACT

A blow molded article comprising a housing defining a hollow interior. The housing comprises a blow molded thermoplastic polymer and a thermoplastic elastomer on a portion of the blow molded thermoplastic polymer. The thermoplastic elastomer is polar and hydrophilic. A coefficient of friction of the thermoplastic elastomer when wet is higher than a coefficient of friction of the blow molded thermoplastic polymer when wet.

17 Claims, 5 Drawing Sheets

WET FRICTION MATERIAL FOR BLOW MOLDED ARTICLES

CROSS REFERENCE TO RELATED APPLICATION(S)

This patent application claims priority to U.S. Provisional Application No. 61/429,810, filed Jan. 5, 2011.

FIELD OF THE INVENTION

The invention generally relates to materials for blow molded articles, more particularly to materials for blow molded articles that have a high coefficient of friction when wet and low tack when dry.

BACKGROUND OF THE INVENTION

Blow molded articles, specifically blow molded product containers, are intended to be grasped or handled by users. Such articles are typically made from blow molded plastics, such as thermoplastic polymers like polyethylene and polypropylene. These materials are inherently slippery, which results in slippage and/or poor engagement of the blow molded article with a skin surface of a user. Moreover, thermoplastic polymers often have a small thickness when blow molded, which also may result in slippage and/or poor engagement of the blow molded article with a skin surface of a user.

In addition, blow molded product containers are typically used in wet or aqueous environments. For example, shampoo bottles are often used in the shower, which may further contribute to slippage and/or poor engagement of the bottle. Various blow molded product containers may hold lubricious materials, such as liquids, gels, non-aerosols, and foams that may spill onto the exterior surface of the container, contributing to slippage and/or poor engagement of the container generally as well as in wet or aqueous environments.

Current approaches may increase the coefficient of friction when wet for a material, but these approaches, however, do not improve a user's perception of gripping the blow molded articles. In one approach, the blow molded article can have a higher coefficient of friction, but such approaches may also have higher tack or perception of stickiness to a user when dry, which may be uncomfortable and undesirable. In addition, current approaches have issues manufacturing materials that adhere to blow molded articles, specifically blow molded product containers.

What is needed, then, is a wet friction material suitable for a blow molded article that preferably is stable and durable, and has a high coefficient of friction when wet and low tack when dry, which would improve engagement of the blow molded article with a user's skin, e.g., for secure grip, potentially without discomfort. What is also needed is a wet friction material that can preferably adhere to or be formed with a blow molded article.

SUMMARY OF THE INVENTION

In one aspect, the invention relates to a blow molded article comprising a housing defining a hollow interior. The housing comprises a blow molded thermoplastic polymer and a thermoplastic elastomer on a portion of the blow molded thermoplastic polymer. The thermoplastic elastomer is polar and hydrophilic. A coefficient of friction of the thermoplastic elastomer when wet is higher than a coefficient of friction of the blow molded thermoplastic polymer when wet.

The foregoing aspect can comprise one or more of the following embodiments. The thermoplastic elastomer can comprise one or more projections extending therefrom, for example, generally cylindrical projections, generally rectangular projections, generally knurled projections, ridges, nonlinear ridges, and combinations thereof. The thermoplastic elastomer can have a coefficient of friction of in a range of about 2.0 to about 3.5 when wet with water, a tack force of about 3 g to about 12 g when dry, and/or a Shore A hardness of about 35 to about 50. The one or more projections can comprise at least two projections, and/or at least one groove can be formed between the at least two projections. The one or more projections can be integrally formed with the thermoplastic elastomer, for example, by injection molding. The thermoplastic elastomer can be integrally formed with the blow molded thermoplastic polymer. The thermoplastic polymer can comprise polyethylene, polypropylene, and combinations thereof. The portion of the blow molded thermoplastic polymer can comprise a handle portion.

In another aspect, the invention relates to a blow molded article comprising a housing defining a hollow interior. The housing comprises a blow molded thermoplastic polymer and a textured thermoplastic elastomer on a portion of the blow molded thermoplastic polymer. The textured thermoplastic elastomer is polar and hydrophilic. A coefficient of friction of the thermoplastic elastomer when wet is higher than a coefficient of friction of the blow molded thermoplastic polymer when wet.

This aspect can comprise one or more of the following embodiments. The textured thermoplastic elastomer can comprise one or more projections extending therefrom, for example, generally cylindrical projections, generally rectangular projections, generally knurled projections, ridges, nonlinear ridges, and combinations thereof. The thermoplastic elastomer defines one or more pores to facilitate removal of water. The thermoplastic elastomer can have a coefficient of friction of in a range of about 2.0 to about 3.5 when wet with water, a tack force of about 3 g to about 12 g when dry, and/or a Shore A hardness of about 35 to about 50. The one or more projections can comprise at least two projections, and/or at least one groove can be formed between the at least two projections. The one or more projections can be integrally formed with the thermoplastic elastomer, for example, by injection molding. The thermoplastic elastomer can be integrally formed with the blow molded thermoplastic polymer. The thermoplastic polymer can comprise polyethylene, polypropylene, and combinations thereof. The portion of the blow molded thermoplastic polymer can comprise a handle portion.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Except as otherwise noted, the articles "a," "an," and "the" mean "one or more."

Consumer goods, such as laundry and household cleaning products, shampoo and hair care products, oral care products, skin care products, and other personal care products that are typically used in wet environments or contain liquids or lubricious materials, are often packaged in various forms of articles, such as containers. These containers are required to have a certain level of mechanical performance to prevent damage during transport and use, and also provide a level of aesthetic appeal to consumers. Commonly, such containers are formed from blow molded thermoplastic polymers.

Containers manufactured from thermoplastic polymers, including polyolefins, polyethylene, and polypropylene, are most commonly manufactured in an extrusion blow molding process or an injection stretch blow process. Nonlimiting examples of thermoplastic polymers and processing thermoplastic polymers via blow molding are described in U.S. Pat. Nos. 4,619,803, 5,711,061, and 7,098,292 and U.S. Patent Application Publication Nos. 2005/0032969, 2006/0175738, 2007/0048473, 2008/0063824, and 2008/0150198. Suitable commercial grade thermoplastic polymers include polyethylene, such as high-density polyethylene or polyethylene terephtalate, and polypropylene are available from suppliers such as Borealis AG (Vienna, Austria), BP p.l.c. (London, United Kingdom), and Total Petrochemicals USA, Inc. (Houston, Tex.), e.g., Total's PPR 7225.

Figure 1:
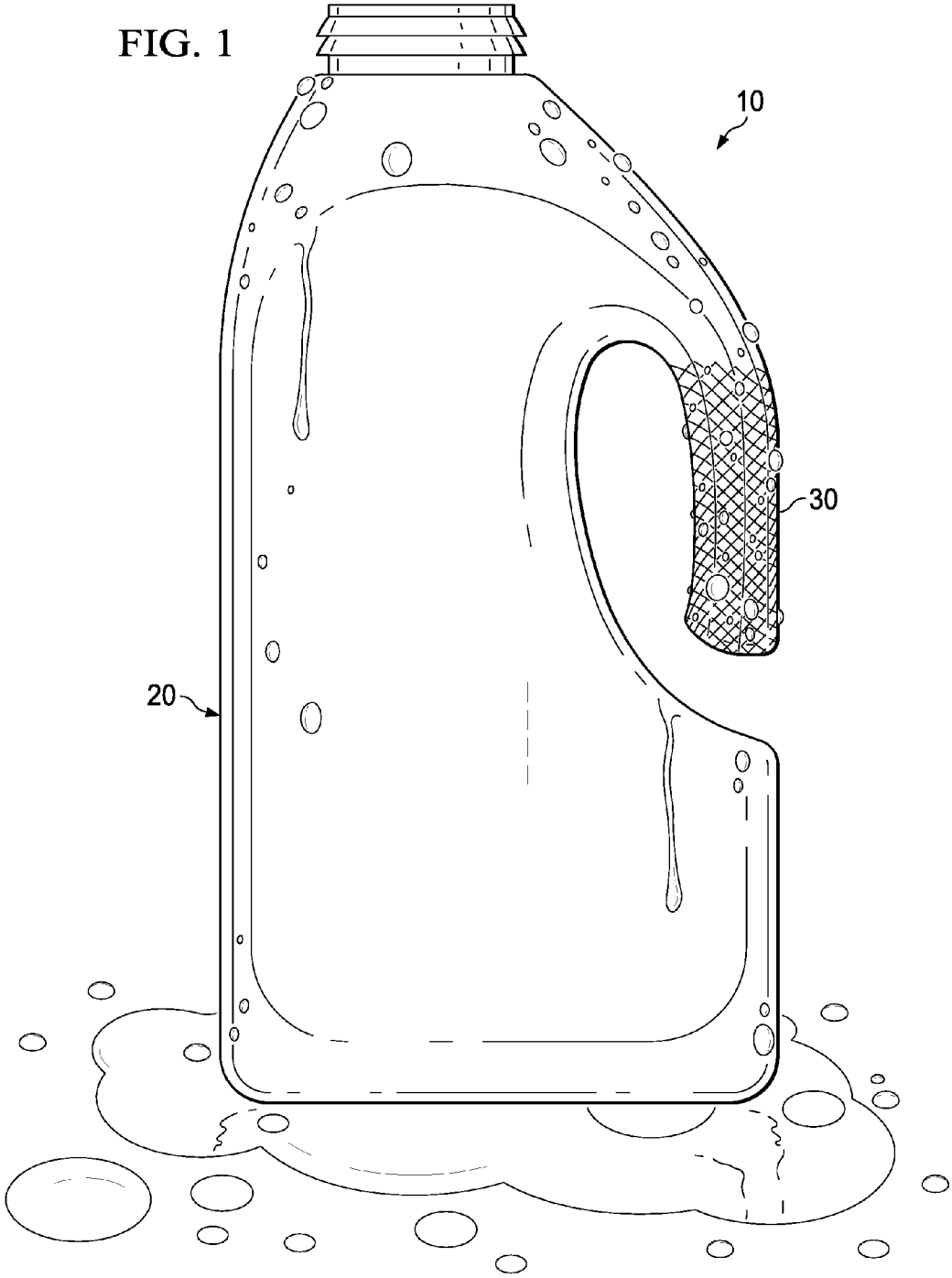
FIG. 1 is a schematic front view of a blow molded article.
Figure 2:
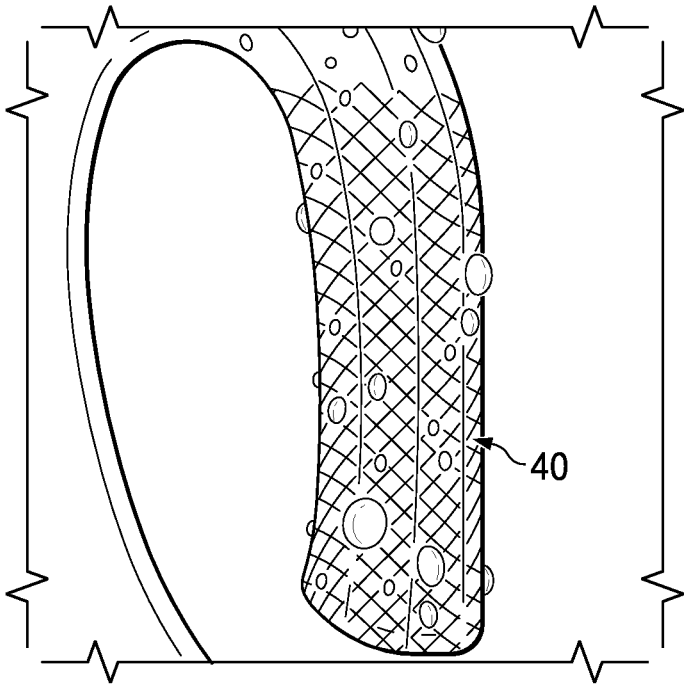
FIG. 2 is a schematic perspective view of a known blow molded article when wet.

Referring to FIGS. 1 and 2, a blow molded article 10 comprises a body 20 and a handle 30. The blow molded article 10 may additionally include a substrate, such as a film substrate, for decorative purposes, e.g., for labels, instructions, information, etc. A portion 40 of the blow molded article, such as the body 20, the handle 30, and/or the substrate, may have low surface energy and/or hydrophobic properties such that water on the portion 40 beads up when the blow molded article 10 is wet with water. Any or all of the blow molded article 10, the body 20, the handle 30, the substrate, and the portion 40 can be made from thermoplastic polymers, such as polyolefins, polyethylene, and polypropylene.

Figure 3:
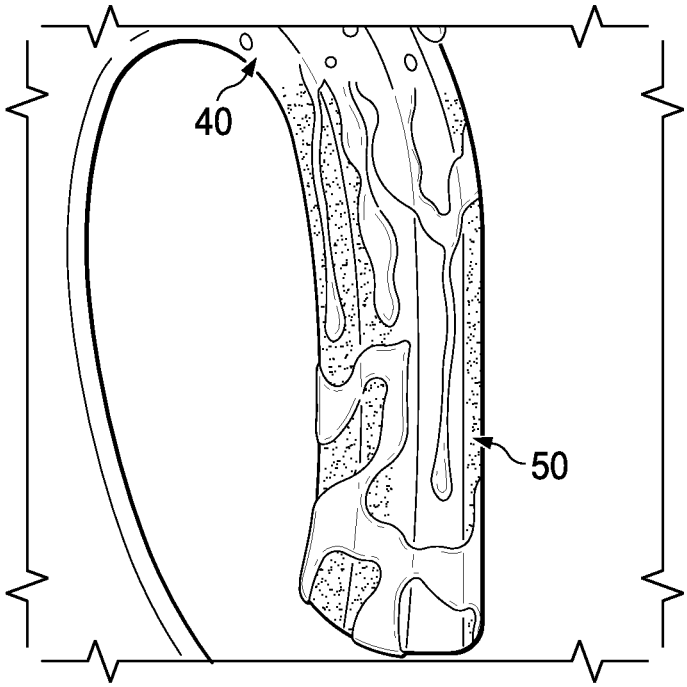
FIG. 3 is a schematic perspective view of a wet friction material when wet, in accordance with an embodiment of the invention.

Referring now to FIG. 3, a wet friction material 50 is disposed on the portion 40 of the blow molded article 10. Additionally or alternatively, the wet friction material is disposed on, formed on, and/or formed with the body 20, the handle 30, the portion 30, and/or the substrate of the blow molded article 10. The wet friction material 50 can be included on or with any skin-engaging portion of the blow molded article 10, such as the handle 30. Additionally or alternatively, the wet friction material 50 is integrally formed with the blow molded article 10, e.g., in a two-stage molded process, in an extrusion blow molding process, or in an injection reheat blow molding process. For example, with respect to extrusion blow molding, a coextrusion variant is used in which the wet friction material would be formed within the blow molding head as a separate layer that is then combined in the melt state with the base material (e.g., a thermoplastic polymer). Both the layers, formed of the wet friction material and the base material, exit the blow molding head either as a stratified laminar flow or separately with a combining just exit of the die will both materials are still in the molten state. Nonlimiting examples of coextrusion blow molding are described in U.S. Pat. No. 4,846,359. With respect to injection reheat blow molding, a hard base layer (e.g., a thermoplastic polymer) is injected into a closed mold, and then the wet friction material is overmolded onto the hard substrate. The composite structure is reheated and placed in a mold where air is introduced internally to blow the multilayer structure outward into the final desired shape.

The wet friction material 50 has a high coefficient of friction when wet, e.g., higher coefficient of friction when wet compared to known blow molded thermoplastic polymers for consumer goods containers. The coefficient of friction is high for the wet friction material 50 when wet in aqueous environments, including water and lubricious materials (e.g., foams, gels, soaps, etc.). Furthermore, the wet friction material 50 may have a higher surface compliance than that of the known blow molded thermoplastic polymer for consumer goods containers, but preferably with low tack. For example, users can securely grip the wet friction material 50, e.g., resulting in improved comfort and control, when wet and not be uncomfortably grippy or sticky when dry. In an embodiment, the wet friction material 50 is polar and hydrophilic. Additionally or alternatively, the wet friction material 50 has high surface energy (e.g., perhaps via a sufficiently low contact angle) so that wettability of the wet friction material 50 is improved and so that water beads are minimized or non-existent when the wet friction material 50 is wet with water. Without intending to be bound by any theory, it is believed that preventing water (or other lubricious materials) from beading and improving wettability (e.g., promoting surfacing wetting) may each or both serve to thin the amount of water that a user must penetrate to engage the skin to the wet friction material 50.

The wet friction material 50 comprises a polymer, preferably a thermoplastic polymer, and even more preferably a thermoplastic elastomer. Nonlimiting examples of suitable thermoplastic elastomers are described in U.S. Pat. Nos. 5,314,940, 5,670,263, 6,610,382, and 6,904,615; and U.S. Patent Application Publication Nos. 2002/0114920 and 2011/0143112. For example, suitable classes of elastomers may comprise hydrated styrene block copolymers (e.g., styrene-ethylene-butylene (SEBS) and styrene-butadiene-styrene (SBS)), anionic triblock copolymers, polyolefin-based thermoplastic elastomers, thermoplastic elastomers based on halogen-containing polyolefins, thermoplastic elastomers based on dynamically vulcanized elastomer-thermoplastic blends, thermoplastic polyether ester or polyester based elastomers, thermoplastic elastomers based on polyamides or polyimides, ionomeric thermoplastic elastomers, partially or fully hydrogenated styrene-butadiene-styrene block copolymers, hydrogenated block copolymers in thermoplastic elastomer interpenetrating polymer networks, thermoplastic elastomers by carbocationic polymerization, polymer blends containing styrene/hydrogenated butadiene block copolymers, block polymers such as polystyrene materials with elastomeric segments, and polyacrylate-based thermoplastic elastomers. Examples of elastomers may include natural rubber, butyl rubber, EPDM rubber, silicone rubber such as polydimethyl siloxane, polyisoprene, polypropylene, polybutadiene, polyurethane, ethylene/propylene/diene terpolymer elastomers, chloroprene rubber, styrene-butadiene copolymers (random or block), styrene-isoprene copolymers (random or block), acrylonitrile-butadiene copolymers, mixtures thereof and copolymers thereof. The block copolymers may be linear, radial or star configurations and may be diblock (AB) or triblock (ABA) copolymers or mixtures thereof. Blends or combinations of these elastomers with each other or with modifying non-elastomers are also contemplated. Elastomers may be available from Arkema Inc., Philadelphia, Pa. (e.g., Pebax® 2533); E. I. duPont de Nemours & Co., Wilmington, Del. (e.g., Zytel® 158L); Kraiburg TPE Corp., Duluth, Ga.; and Kraton Polymers U.S. LLC, Houston, Tex.

Additionally or alternatively, the wet friction material 50 is a composite structure, such as a thermoplastic elastomer modified with additives, fillers, and/or rubber mixtures or modifiers. Suitable composite structures, additives, and/or fillers are described in U.S. Pat. No. 3,972,528. For examples, additives may be one or more of the following additives: paraffinic white oils, inorganic bulking agents, ether ester plasticizers, sulfurized mineral oil, alkenyl amide, styrol, polystyrol, petrolatum, polyisobutylene, polybutene, styrene, elastomeric styrene, ethylene, butylene, aqueous carboxylated synthetic polymer having a minimum film-forming temperature (MFFT) (e.g., 10 degrees Celsius or below), low MFFT synthetic polymer reinforced during manufacturing by co-agglomeration with polystyrene, combinations thereof, or any other suitable additive to achieve a wet friction material 50 that has a high coefficient of friction when wet and low tack when dry. Additionally or alternatively, fillers may be one or more if the following fillers: clay treated with lignin sulfonate, pulverized fragments of foamed melamine resin, porous granulated aluminum oxide powder, diatomaceous earth, silica, acrylonitrile pulp, granular filler having a surface area of about 35 $m^2/g$ to about 410 $m^2/g$, clay (about 5 parts by weight to about 30 parts by weight), aluminum hydroxide, hollow aluminum oxide particle, dibutylphtalate (applied on carbon fiber base material) that has been hardened, fired, and carbonized), vulcanized rubber particles, aramid fiber, waste ash, ethylene vinyl acetate, polyethelyene, rubber, elastomer, hollow carbonate, alumina, carbide, carborundum, diamond powder, white carbon (about 15 percentage by weight to about 80 percentage by weight), ceramic fiber (about 5 percentage by weight to about 50 percentage by weight), combinations thereof, or any other suitable filler to achieve a wet friction material 50 that has a high coefficient of friction when wet and low tack when dry. The quantity of any additives and/or fillers is controlled such that tensile strength is maintained at an acceptable level with adhesion to a substrate also being maintained at an acceptable level.

Figure 4:
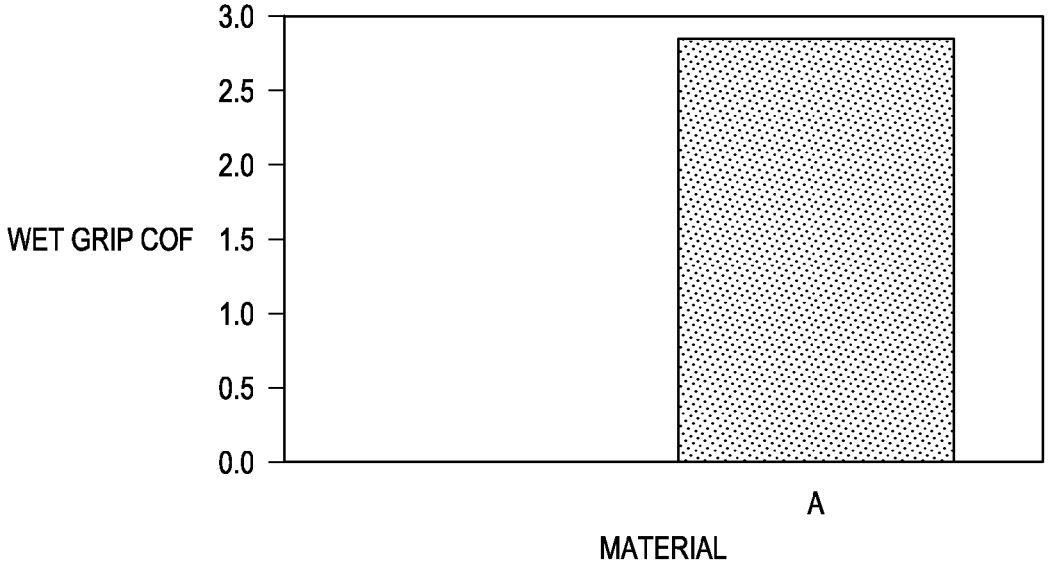
FIG. 4 is a chart illustrating the coefficient of friction of a wet friction material according to an embodiment of the invention when wet.
Figure 9:
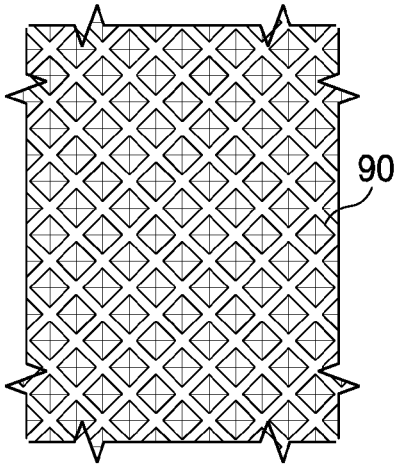
FIG. 9 is a schematic perspective view of still another textured surface according to an embodiment of the invention.
Figure 5:
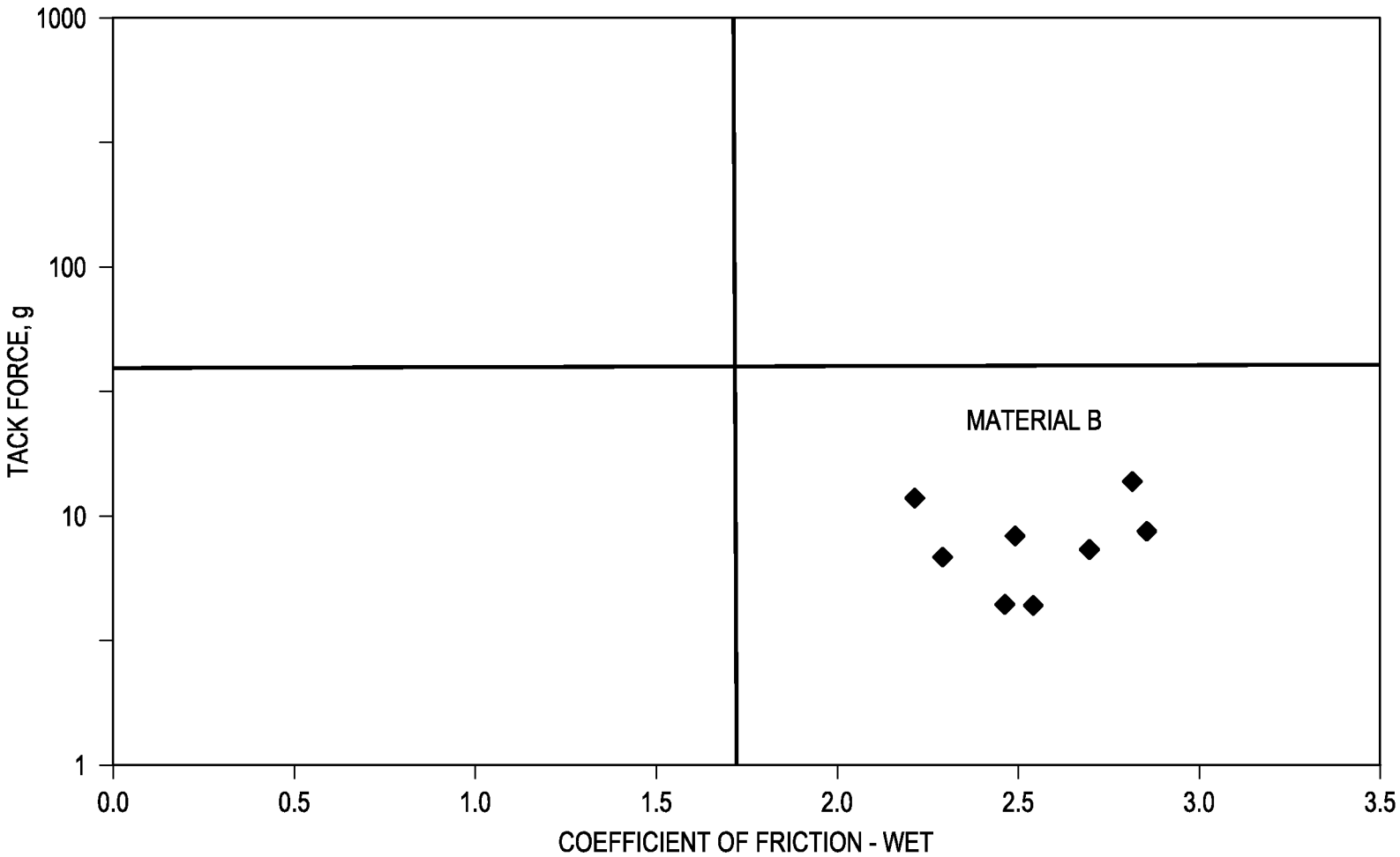
FIG. 5 is a chart illustrating properties of tack and coefficient of friction when wet for a wet friction material according to an embodiment of the invention.
Figure 6:
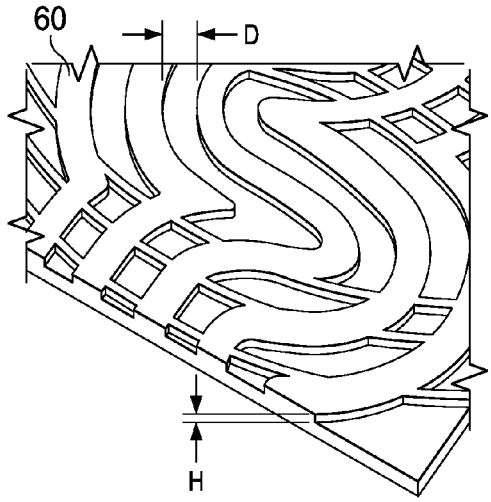
FIG. 6 is a schematic perspective view of a textured surface in accordance with an embodiment of the invention.
Figure 7:
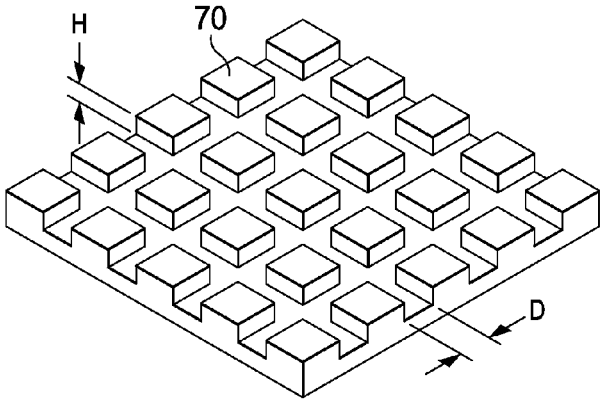
FIG. 7 is a schematic perspective view of another textured surface in accordance with an embodiment of the invention.
Figure 8:
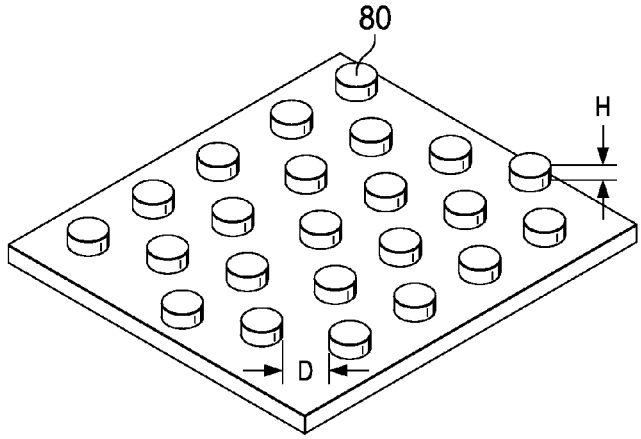
FIG. 8 is a schematic perspective view of yet another textured surface in accordance with an embodiment of the invention.

FIGS. 4 and 5 illustrate various properties, such as coefficient of friction when wet and tack force when dry, wet friction materials A and B. Tack is a characteristic of a material to form an immediate cohesive adherence to a contacting surface. Therefore, tack form is the measure of resistance of the material to separate from the contacting surface. In an embodiment, wet friction material A has a coefficient of friction when wet with water of about 2.8. The tack force of the wet friction material B can be similar to that of the known blow molded thermoplastic polymer, though the tack force of wet friction materials can be greater than or lesser than the known blow molded thermoplastic polymer. The tack force of the wet friction material B is in a range of about 1 g to about 25 g, preferably about 3 g to about 12 g. In alternative embodiments, the tack force of a wet friction material in accordance with an embodiment of the invention can be much higher than that of the known blow molded thermoplastic polymer. For example, the tack force of a wet friction material can be in a range of about 200 g to about 700 g, preferably about 300 g to about 500 g. The coefficient of friction when wet with water for the wet friction material B is preferably in a range of about 2.1 to about 3.2, and even more preferably about 2.4 to about 2.8. The coefficient of friction when wet with lubricious material, for example, using about 2 g of Gillette® Series Sensitive Skin Shave Gel, wet friction materials according to embodiments of the invention is preferably in a range of about 0.28 to about 2.0, and even more preferably about 0.29 to about 0.5.

Generally, wet friction materials of the invention have a higher coefficient of friction when dry, higher coefficient of friction when wet, and higher surface energy. Additionally or alternatively, the hardness of a wet friction material can be in a range of Shore A hardness of about 5 to about 95, preferably about 30 to about 60, and even more preferably about 35 to about 53. The coefficient of friction when dry for wet friction materials can be in a range of about 2.0 to about 5.3, preferably about 2.4 to about 3.0. The coefficient of friction when wet with water for wet friction materials can be in a range of about 1.4 to about 5.0, preferably about 1.9 to about 2.8. Surface energies of wet friction materials can be in a range of about 25 $mJ/m^2$ to about 52 $mJ/m^2$, preferably about 27 $mJ/m^2$ to about 34 $mJ/m^2$.

Referring now to FIGS. 6 through 9, various embodiments of wet friction materials of the present invention can optionally include projections or textured patterns extending from the wet friction material to improve engagement of the wet friction material with a skin. The projections and textured patterns can also break the surface tension of the water (or lubricious material) or be exposed above the water (or lubricious material) for engagement with skin. In one embodiment, a textured pattern 60 can be similar to that of a fingerprint pattern with nonlinear shapes, concave and/or convex curvatures, and intersecting lines. In another embodiment, projections 70 can have a generally rectangular shape, such that a cross-section of each of the projections 70 is generally square. By "generally rectangular" the projections 70 include non-rectangular elements, e.g., ridges, protrusions, or recesses, and/or may include regions along its length that are not rectangular, such as tapered and/or flared ends due to manufacturing and design considerations. In yet another embodiment, projections 80 can be generally cylindrical, such that a cross section of the each of the projections 80 can be generally circular. By "generally cylindrical" the projections 80 include non-cylindrical elements, e.g., ridges, protrusions, or recesses, and/or may include regions along its length that are not cylindrical, such as tapered and/or flared ends due to manufacturing and design considerations. In still another embodiment, projections 90 can be generally knurled, such that a cross-section of each of the projections 90 can be generally diamond-shaped. The projections can form any geometric, polygonal, arcuate shape, or combinations thereof. For example, the projections can include a combination of a knurled pattern and arcuate ridges. In an embodiment, the projections and/or the textured patterns are integrally formed with the wet friction material. Additionally or alternatively, the projections and/or textured patterns can be configured and shaped to form channels for fluid removal. The channels can be grooves formed between the projections. In an additional or alternative embodiment, the channels can define pores to remove/wick fluid away from the wet friction material by absorbing fluids, e.g., via an absorbent layer beneath the wet friction material, or by allowing the fluid to drain underneath the wet friction material. In various embodiments, without intending to be bound by any theory, it is believed that a range of percentage ratios of the distance between projections (D) over the height of the projections (H) promote pleasant sensory touch, preferably in a range of about 25% to about 75%, even more preferably about 60%. Further, it is believed that the less feedback of the projection on the skin surface, such as a fingertip, provides a more comfortable feeling. For example, the less feedback of the projection, that is a larger surface area to touch the skin, is more comfortable; in contrast, the higher feedback of the projection, that is a smaller surface area or a shaper edge, to touch a skin is less comfortable.

Test Procedure for Measuring Properties

Hardness

Hardness of materials is tested at room temperature and at 36 degrees Celsius using Shore A Durometer Instron Model 9130-35 (available from Instron, Norwood, Mass.) according to ASTM 2240-00.

Coefficient of Friction when Dry and when Wet

Coefficient of friction for each material to be tested is measured using a MTT175 tensile tester (available from Diastron Limited, Broomall, Pa.) in which a skin mimic preparation is dragged across the material to be tested. The coefficient of friction for each material is tested when dry, wet with water, or in the presence of various lubricious materials (e.g., foams, gels, non-aerosols). To mimic skin, a polyurethane textured pad is prepared. Nonlimiting examples of skin mimic preparations and polyurethane textured pads are described in U.S. Patent Application Publication Nos. 2007/0128255 and 2009/0212454. A sled/probe is used in which the surface is polished stainless steel. The skin mimic is attached to the sled/probe surface via double-sided tape or clips. The material to be tested is attached to the stage below the sled/probe surface with preferably double-sided tape and optionally clips. If heat is used, the water bath to warm the platform of the MTT175 tester is set to 39+/−1 degrees Celsius and water is circulated. The sled/probe with the skin mimic is mounted to the floating parallelogram cradle of the tester, which is connected to a load cell. The angle of the sled/probe with the skin mimic is set so that the skin mimic surface is flat against the stage, which is attached to the material to be tested, with an approximate angle of about 35 degrees. The parallelogram cradle is leveled to be flat. Downward force can be adjusted by moving weights along a threaded shaft in which the downward force is adjusted to about 175 gm to about 230 gm. If shave preparations (e.g., lubricious materials) are used, lather is generated by applying the shave preparation to the material to be tested, lathering by hand for about 30 seconds to about 60 seconds. For gels, 2.5+/−0.7 grams of gel is applied. For foams, 3.0+/−0.7 grams of foam is applied. A draw down bar can be used to level the surface of the shave preparation, set at about 2 mm, across the skin mimic. Before performing the tests, the load cells are zeroed. To run the test measuring the coefficient of friction, software associated with the MTT175 tester is used and set at about 2000 gmf load cell with a displacement of about 60 mm and a speed of about 1500 mm/min at room temperature. Of the displacement, a smaller range of displacement is analyzed, such as about 110 mm to about 150 mm. A force of about 226 g is applied in which the force is calibrated with a Mettler-Toldeo Balance Serial No. 114020837 (available from Mettler-Toledo, Inc., Columbus, Ohio). When measuring the coefficient of friction when wet, about 1 mL of room temperature tap water under the probe is used. About one to about three strokes are completed for each test and about three tests completed for each material. To perform another test, a new material is used. The skin mimic on the test head is washed with water and an alcohol wipe, then blotted dry with a paper towel. Alternatively, the skin mimic is replaced. The test head is dried before use.

To maximize reliability of data, at least three different operators perform the tests with a relative standard deviation of about less than 20% for the first stroke data over three separate tests—each operator over a period of three separate days. For each operator, the relative standard deviation is about less than 20%.

Tack

Tack information for each material is measured using a TA.XTPlus Texture Analyzer and its associated software (available from Texture Technologies Corporation, Scarsdale, N.Y.). Skin mimic, as prepared as described above, is attached to the round probe end of the Texture Analyzer instrument via double-sided tape and the material to be tested is attached to the metal stage of the Texture Analyzer instrument, which is below the Tack probe, via double-sided tape. The instrument is calibrated such that the height is set at 10 mm and the force is set using a 2000 g weight. Each cycle of testing includes probe contact with the material to be tested for about 5 seconds. The probe contact is then pulled away at about 5 mm/second. The probe contacts the material to be tested a second time for about 5 seconds and is then pulled away at about 1 mm/second. Optionally, to maximize good, repeatable contact of the probe with the material to be tested, the probe contacts the material for the second time after about a 5 second delay.

After a cycle of testing is complete, the skin mimic is washed with alcohol and is blotted dry with a paper towel. The material to be tested is replaced with a fresh, new material and repeated for a total of at least three cycles of sampling per material.

To maximize reliability of data, at least three different operators perform the tests with a relative standard deviation of about less than 50%, preferably about less than 20%, over three separate tests—each operator over a period of three separate days.

Surface Energy

Contact angle measurements is used to determine the surface energy of the materials to be tested in which the contact angle depends on the compatibility between the surface properties of the wetting liquid and the material to be tested. Surface energy is calculated from Young's equation in measures of energy per unit area ($mJ/m^2$). Contact angle measurements utilize a Contact Angle and Surface Tension instrument (available from First Ten Angstroms, Portsmouth, Va.), such as FTA200, with FTA video 2.0 software in which the instrument includes a camera that can capture many frames per second, a pump to dispense drops from syringes, and a stage to place the sample while frames are collected. To set up the test, the lighting is adjusted so that there is a white background and a dark drop and the focus is adjusted.

The material to be tested is placed below the syringe and leveled. The syringe is filled with a first liquid such that no bubbles remain. The program is initiated and run such that the instrument drops the liquid and takes measurements of contact angle. Two solvents are used, specifically diiodomethane and water. Owens-Wendt regression analysis is conducted to obtain surface energy measurements based on these two solvents.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blow molded article comprising:

a housing defining a hollow interior, the housing comprising:

a blow molded thermoplastic polymer; and a thermoplastic elastomer on a portion of the blow molded thermoplastic polymer, wherein the thermoplastic elastomer is polar and hydrophilic and a coefficient of friction of the thermoplastic elastomer when wet is higher than a coefficient of friction of the blow molded thermoplastic polymer when wet, the thermoplastic elastomer has a coefficient of friction from about 2.0 to about 3.5 when wet with water and a Shore A hardness of about 35 to about 50.

2. The blow molded article of claim 1, wherein the thermoplastic elastomer comprises one or more projections extending therefrom.

3. The blow molded article of claim 2, wherein the one or more projections is selected from the group consisting of cylindrical projections, rectangular projections, knurled projections, ridges, and combinations thereof.

4. The blow molded article of claim 2, wherein the one or more projections comprises at least two projections and at least one groove is formed between the at least two projections.

5. The blow molded article of claim 2, wherein the one or more projections are integrally formed with the thermoplastic elastomer.

6. The blow molded article of claim 5, wherein the one or more projections are integrally formed with the thermoplastic elastomer by injection molding.

7. The blow molded article of claim 1, wherein the thermoplastic elastomer is integrally formed with the blow molded thermoplastic polymer.

8. The blow molded article of claim 1, wherein the portion of the blow molded thermoplastic polymer comprises a handle portion.

9. A blow molded article comprising:

a housing defining a hollow interior, the housing comprising:

a blow molded thermoplastic polymer; and a textured thermoplastic elastomer on a portion of the blow molded thermoplastic polymer, wherein the textured thermoplastic elastomer is polar and hydrophilic and a coefficient of friction of the thermoplastic elastomer when wet is higher than a coefficient of friction of the blow molded thermoplastic polymer when wet, the thermoplastic elastomer has a coefficient of friction from about 2.0 to about 3.5 when wet with water and a Shore A hardness of about 35 to about 50.

10. The blow molded article of claim 9, wherein the textured thermoplastic elastomer comprises one or more projections extending therefrom.

11. The blow molded article of claim 10, wherein the one or more projections comprises at least two projections and at least one groove can be formed between the at least two projections.

12. The blow molded article of claim 10, wherein the one or more projections are integrally formed with the thermoplastic elastomer.

13. The blow molded article of claim 12, wherein the one or more projections are integrally formed with the thermoplastic elastomer by injection molding.

14. The blow molded article of claim 10, wherein the one or more projections is selected from the group consisting of cylindrical projections, rectangular projections, knurled projections, ridges, and combinations thereof.

15. The blow molded article of claim 9, wherein the thermoplastic elastomer is integrally formed with the blow molded thermoplastic polymer.

16. The blow molded article of claim 9, wherein the thermoplastic polymer comprises polyethylene, polypropylene, and combinations thereof.

17. The blow molded article of claim 9, wherein the portion of the blow molded thermoplastic polymer comprises a handle portion.

* * * * *